US012458903B2

(12) United States Patent
Colayco et al.

(10) Patent No.: US 12,458,903 B2
(45) **Date of Patent: *Nov. 4, 2025**

(54) EQUIPMENT, METHOD AND KIT FOR MANUAL FORMING OF TRANSIENT MATERIAL INTO A STRUCTURE

(71) Applicant: Sand Castle Science, LLC, Reunion, FL (US)

(72) Inventors: Javier Colayco, Reunion, FL (US); Thuy Colayco, Reunion, FL (US); Valentina Colayco, Reunion, FL (US)

(73) Assignee: SAND CASTLE SCIENCE, LLC, Winter Park, FL (US)

( * ) Notice: Subject to any disclaimer, the term of this patent is extended or adjusted under 35 U.S.C. 154(b) by 13 days.

This patent is subject to a terminal disclaimer.

(21) Appl. No.: 18/434,113

(22) Filed: Feb. 6, 2024

(65) Prior Publication Data

US 2024/0173640 A1 May 30, 2024

Related U.S. Application Data

(63) Continuation of application No. 17/477,128, filed on Sep. 16, 2021, now Pat. No. 11,918,933.

(Continued)

(51) Int. Cl.
*A63H 33/32* (2006.01)

(52) U.S. Cl.
CPC ..... *A63H 33/32* (2013.01)

(58) Field of Classification Search
CPC ..... A63H 33/00; A63H 33/32; B65D 65/00; B65D 65/466

(Continued)

(56) References Cited

U.S. PATENT DOCUMENTS 3,691,672 A * 9/1972 Pendill ..... A63H 33/044 446/70
3,736,697 A * 6/1973 Keces ..... A63H 33/32 446/70

(Continued)

OTHER PUBLICATIONS

Packable Pails, https://www.amazon.com/Packable-Collapsible-Shovel-Perfect-AquaVault/dp/BOONC5XMSM/ref=sr_1_1 ?dchild=1 &keywords=packable+pails+collapsible+5+liter+with+handle+shovel+travel+camping&qid=1631066361 &sr=8-1, accessed Dec. 17, 2021, one page.

(Continued)

*Primary Examiner* — Joseph B Baldori
(74) *Attorney, Agent, or Firm* — Dickinson Wright PLLC

(57) ABSTRACT

Equipment for building sand castles can include a body having a single, monolithic, hollow structure with a vertical axis and a sidewall that is continuous and uninterrupted in a rotational direction about the vertical axis. The sidewall can include an inner pattern that is castle-like in appearance. The inner pattern can form an outer pattern in sand located inside the body. The body also has an open bottom, an open top that is completely unobstructed and has no inward protrusion, and a top radial dimension at the open top is smaller than a bottom radial dimension at the open bottom such that the body is tapered. A handle extends from the body adjacent the open top. The handle can be used to vertically lift the body from the sand located inside the body to form a freestanding sand castle without support from the body.

7 Claims, 14 Drawing Sheets

Related U.S. Application Data

(60) Provisional application No. 63/079,617, filed on Sep. 17, 2020.

(58) Field of Classification Search
USPC ..... 472/126; 446/70
See application file for complete search history.

(56) References Cited

U.S. PATENT DOCUMENTS

| | | | | |
|---|---|---|---|---|
| 3,829,926 | A * | 8/1974 | Salladay | B44D 3/126 222/572 |
| D311,432 | S * | 10/1990 | Cattoni | D21/816 |
| 5,632,926 | A * | 5/1997 | Dyer, Jr. | F25C 1/22 249/126 |
| 6,126,876 | A * | 10/2000 | Demarzo | A63H 33/32 264/109 |
| 6,415,926 | B1 * | 7/2002 | Long | A63H 33/32 446/70 |
| 7,273,573 | B2 * | 9/2007 | Racunas, Jr. | B44C 3/06 425/DIG. 57 |
| D694,592 | S * | 12/2013 | Hukill | D7/691 |
| 10,010,804 | B1 * | 7/2018 | Jung | A63H 33/001 |
| 10,080,979 | B2 * | 9/2018 | Lane | A63H 33/32 |
| 11,408,187 | B2 * | 8/2022 | Lane | E04G 9/02 |
| 11,420,133 | B2 * | 8/2022 | Loik | A63H 33/32 |
| D978,980 | S * | 2/2023 | Colayco | D21/472 |
| 2008/0072432 | A1 * | 3/2008 | Teys | A47J 43/281 206/572 |
| 2010/0248581 | A1 | 9/2010 | Adams | |
| 2018/0207542 | A1 | 7/2018 | Lane | |
| 2020/0368632 | A1 * | 11/2020 | Loik | A63H 33/001 |
| 2020/0391135 | A1 | 12/2020 | Reimann | |

OTHER PUBLICATIONS https://www.hearthsong.com/medias/sys_master/images/images/he7/h28/11567203024926/11567203024926.jpg, accessed Dec. 17, 2021, one page.

https://m.media-amazon.com/images///4117nCEVAdL._AC_SX466_. jpg, accessed Dec. 17, 2021, one page.

* cited by examiner

EQUIPMENT, METHOD AND KIT FOR MANUAL FORMING OF TRANSIENT MATERIAL INTO A STRUCTURE

This application is a continuation of and claims priority to and the benefit of U.S. patent application Ser. No. 17/477,128, filed Sep. 16, 2021, which claims priority to and the benefit of U.S. Prov. Pat. App. No. 63/079,617, filed Sep. 17, 2020, each of which is incorporated herein by reference in its entirety.

TECHNICAL FIELD

This disclosure relates in general to building sand castles or snow castles and, in particular, to a system, method and apparatus for manual molding of transient material, such as sand or snow.

BACKGROUND

Conventional equipment and toys for building sand castles or snow castles are closed molds, such as buckets, having only one open end to fill with sand. Such designs are limited since the closed mold must be flipped over to release the sand. The flipping process often cracks or breaks the molded sand inside the closed mold. Since closed molds must be flipped, the size of closed molds is limited since they are heavy when filled with wet sand. For children, it is difficult if not impossible to flip larger closed molds filled with wet sand.

Moreover, the sand used in closed molds must be the right composition. When a closed mold is used, the sand cannot have too much stray matter, such as broken shells. In addition, the sand must include some silica or clay to properly stick, and there must be the right ratio of water to sand. Without these conditions, the sand will either not release from the closed mold (due to suction from the closed end), fall out of the closed mold like powder (if the sand is too dry), or some undesirable mix of these two problems that does not provide a uniform sand structure. Thus, improvements in sand castle building equipment continue to be of interest.

SUMMARY

Embodiments for equipment for building sand castles are disclosed. For example, the equipment can include a body having a single, monolithic, hollow structure with a vertical axis and a sidewall that is continuous and uninterrupted in a rotational direction about the vertical axis. The sidewall can include an inner pattern that is castle-like in appearance. The inner pattern can form an outer pattern in sand located inside the body. The body also has an open bottom, an open top that is completely unobstructed and has no inward protrusion, and a top radial dimension at the open top is smaller than a bottom radial dimension at the open bottom such that the body is tapered. A handle extends from the body adjacent the open top. The handle can be used to vertically lift the body from the sand located inside the body to form a freestanding sand castle without support from the body.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

It shall be noted that some of the details and/or features shown in the drawings herein may not be drawn to scale for clarity purposes.

The use of the same reference symbols in different drawings indicates similar or identical items.

DETAILED DESCRIPTION

Figure 1:
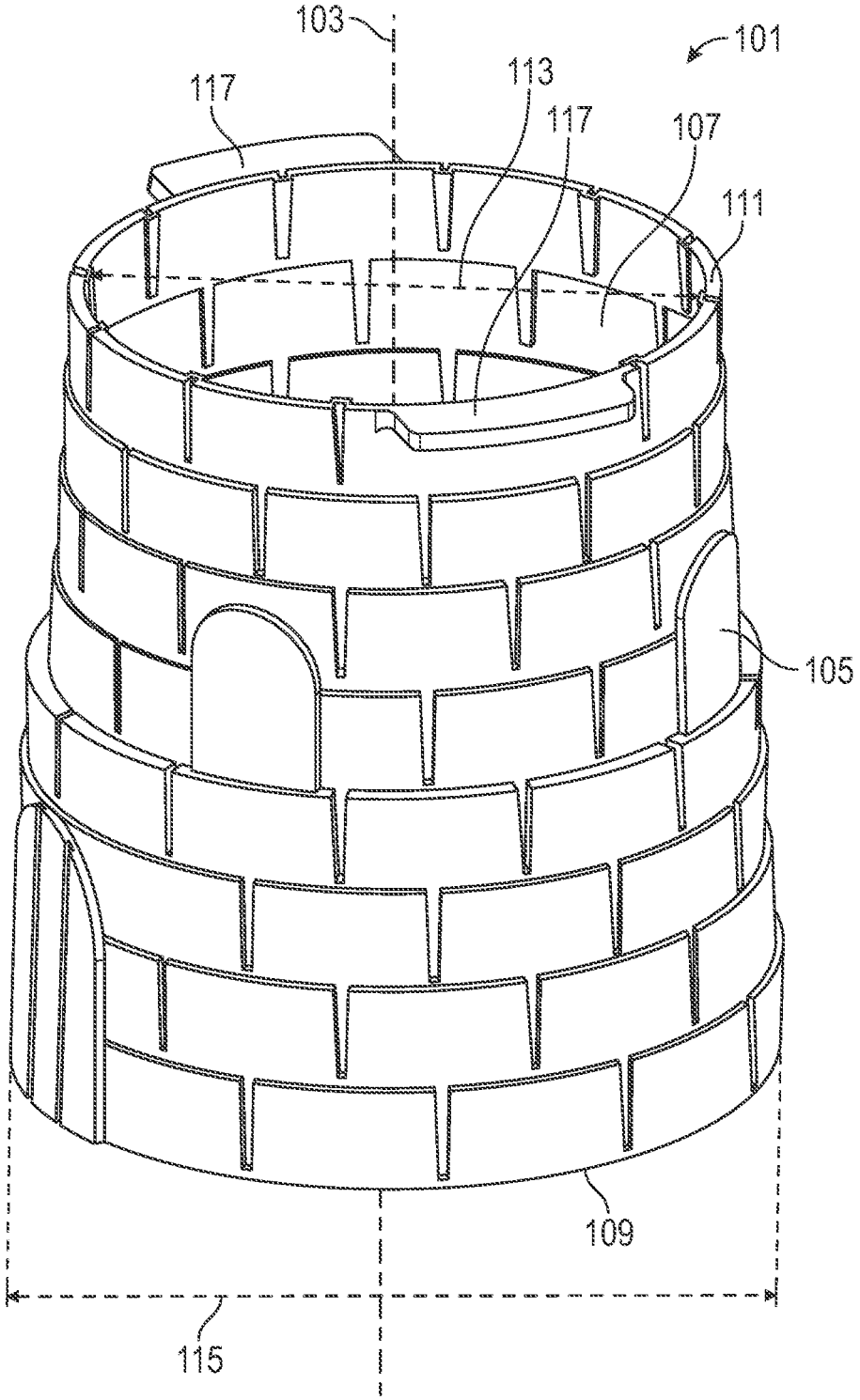
FIG. 1 is an isometric view of an embodiment of a mold for making sand castles.
Figure 2:
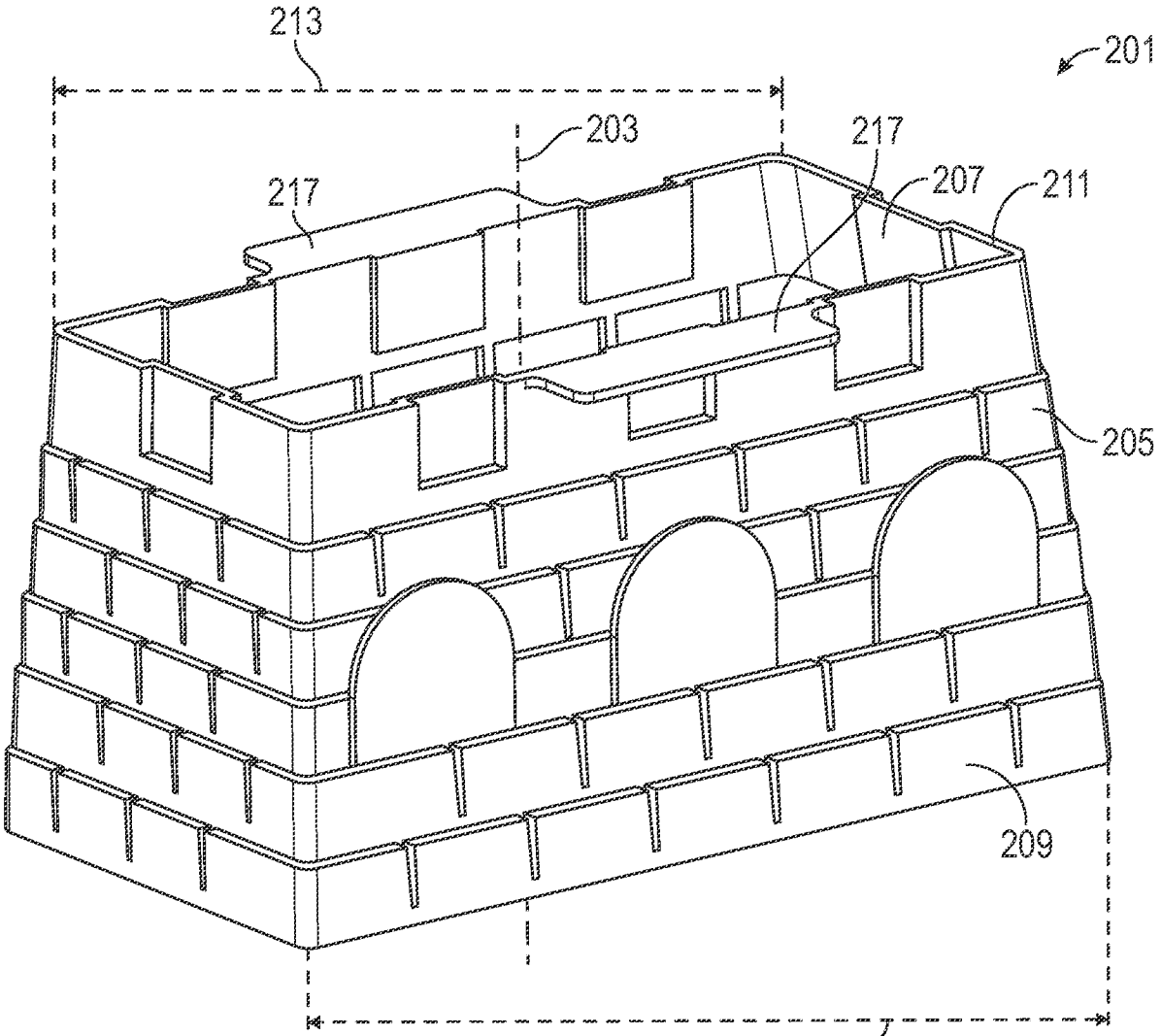
FIG. 2 is an isometric view of an alternate embodiment of a mold for making sand castles.

Embodiments of a system, method and apparatus for manually forming a transient material into a structure are disclosed in FIGS. 1-17. For example, equipment for building sand castles can comprise a body 101. The body 101 can be a single, monolithic, hollow structure comprising a vertical axis 103 and a sidewall 105 that is continuous and uninterrupted in a rotational direction about the vertical axis 103. In some versions, the body 101 can have a shape that can be cylindrical (FIG. 1), rectangular (FIGS. 2 and 16, with analogous numbering, such as body 201 for body 101, etc.), hexagonal, octagonal, frustoconical, etc.

Embodiments of the sidewall 105 can include an inner pattern 107 that is castle-like in appearance. The inner pattern 107 can be configured to form the inner pattern in sand located inside the body 101. The body 101 also can have an open bottom 109, an open top 111 that is completely unobstructed and has no inward protrusion adjacent to the open top 111. Although the inner pattern 107 undulates like a traditional castle wall made with rectangular stones, the inner pattern 107 does not have any inward protrusions that obstruct the open top 111. A top radial dimension 113 at the open top 111 can be smaller than a bottom radial dimension 115 at the open bottom 109 such that the body 101 is tapered. As used herein, the term 'radial' can mean in a direction that is orthogonal or perpendicular to the vertical axis 103. The vertical axis 103 can be anywhere and does not have to be in the center of circle.

A handle 117 can extend from the body 101 adjacent the open top 111. The handle 117 can be configured to vertically lift the body 101 from the sand located inside the body 101 to form a freestanding sand castle without support from the body 101. For example, the handle 117 can include external handles that are perpendicular to the vertical axis 103. Upper surfaces of the handles 117 can be flush with the open top 111 of the body 101. In another example, the handle 117 can comprise external handles that extend vertically from the body 101. Alternatively, the handle 117 can include an external rim adjacent a perimeter of the open top 111.

Versions of the equipment can further comprise a scoop 121 (FIG. 3) configured to fill the body 101 with sand through the open top 111 of the body 101. Other versions also can include a trowel 131 (FIG. 4), bucket 141 (FIGS. 5 and 17), trowel 151 (FIG. 6), carver or other tools. The trowel 151 can be filled and packed with sand and then placed on top of the sand castle constructed by body 101. The trowel 151 is then removed via handle 153 and thereby shapes a top of the sand castle. The trowel 151 can include a side wall and inner pattern as described elsewhere herein.

Some embodiments of the body 101 do not include separate components that are assembled to form the body 101. Versions of the open top 111 of the body 101 do not comprise an inner lip or an inner flange. The body 101 can be translucent or transparent. Examples of the body 101 can include no features configured to interlock with another tool. Versions of the body 101 are not threaded.

Figure 4:
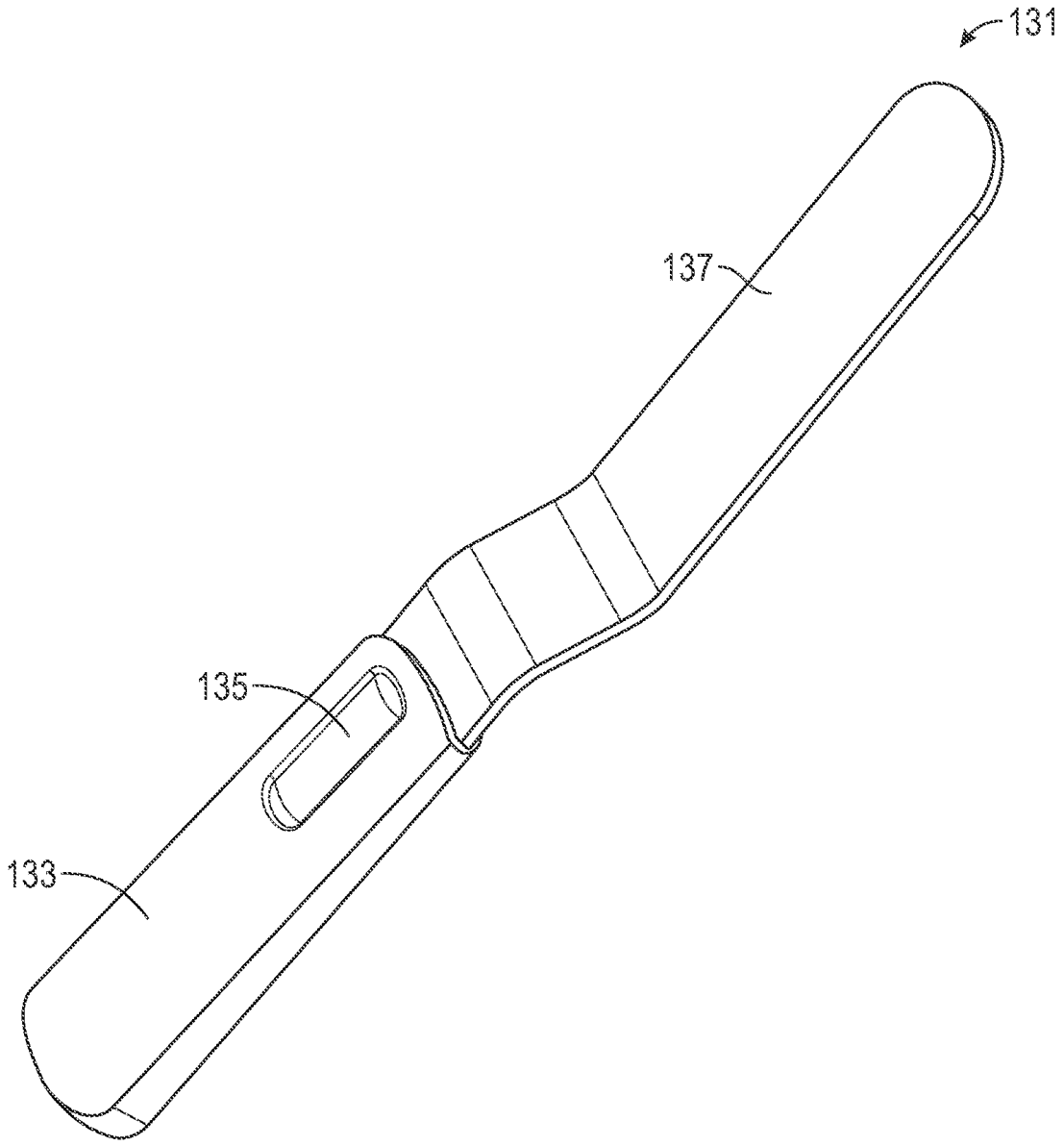
FIG. 4 is an isometric view of an embodiment of a trowel for making sand castles.
Figure 5:
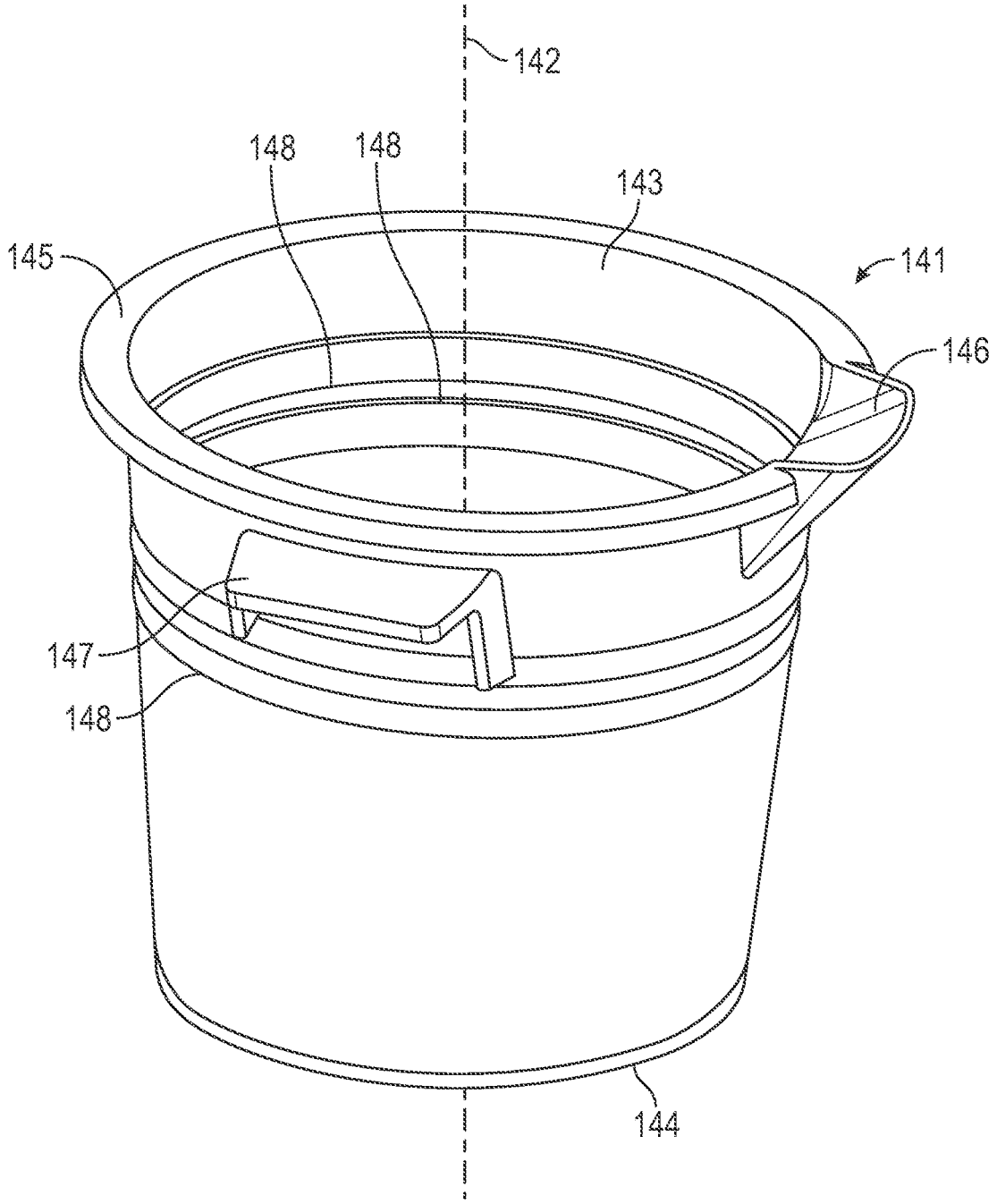
FIG. 5 is an isometric view of an embodiment of a bucket for making sand castles.
Figure 6:
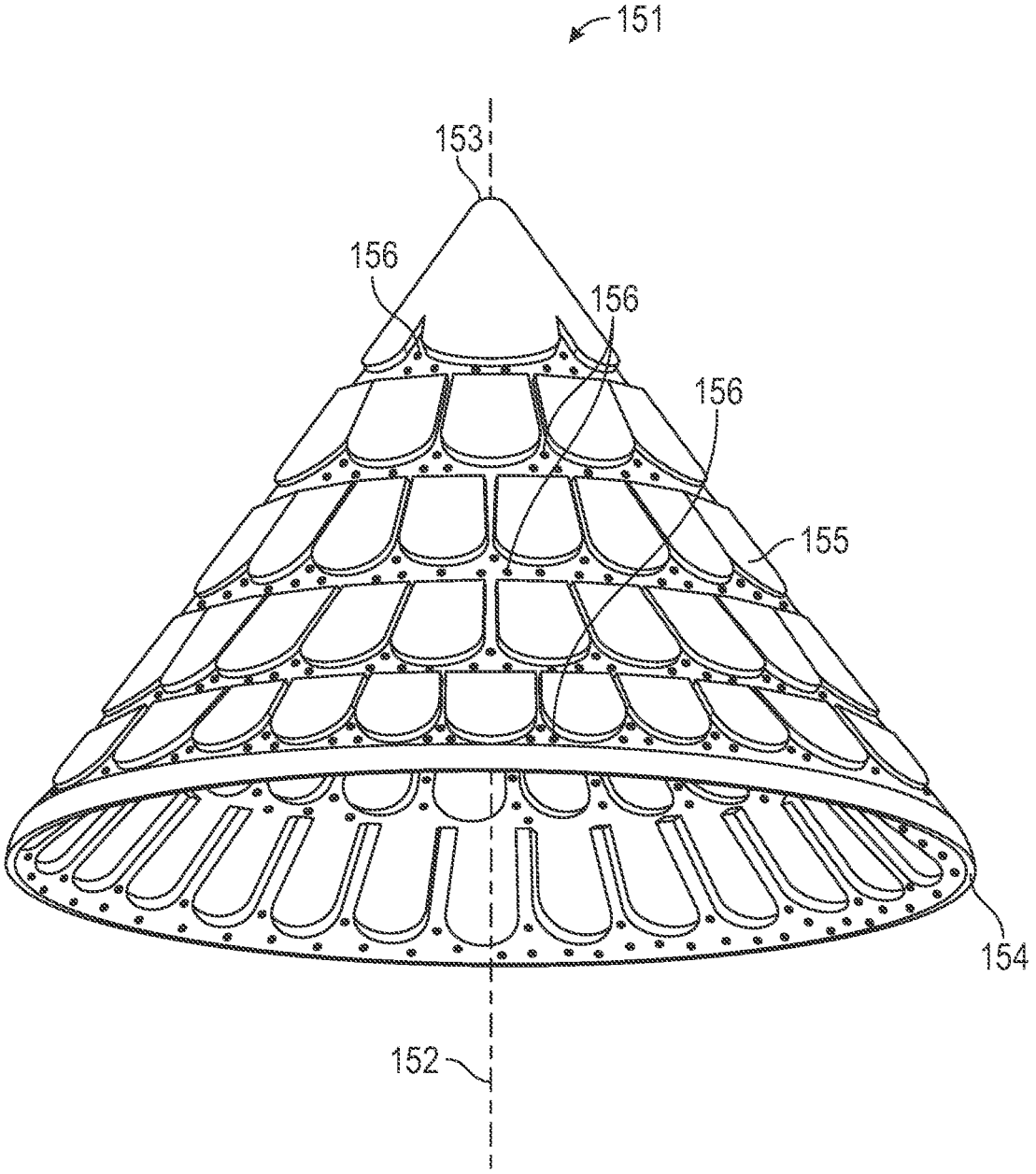
FIG. 6 is an isometric view of an embodiment of a roof top mold for making sand castles.
Figure 7:
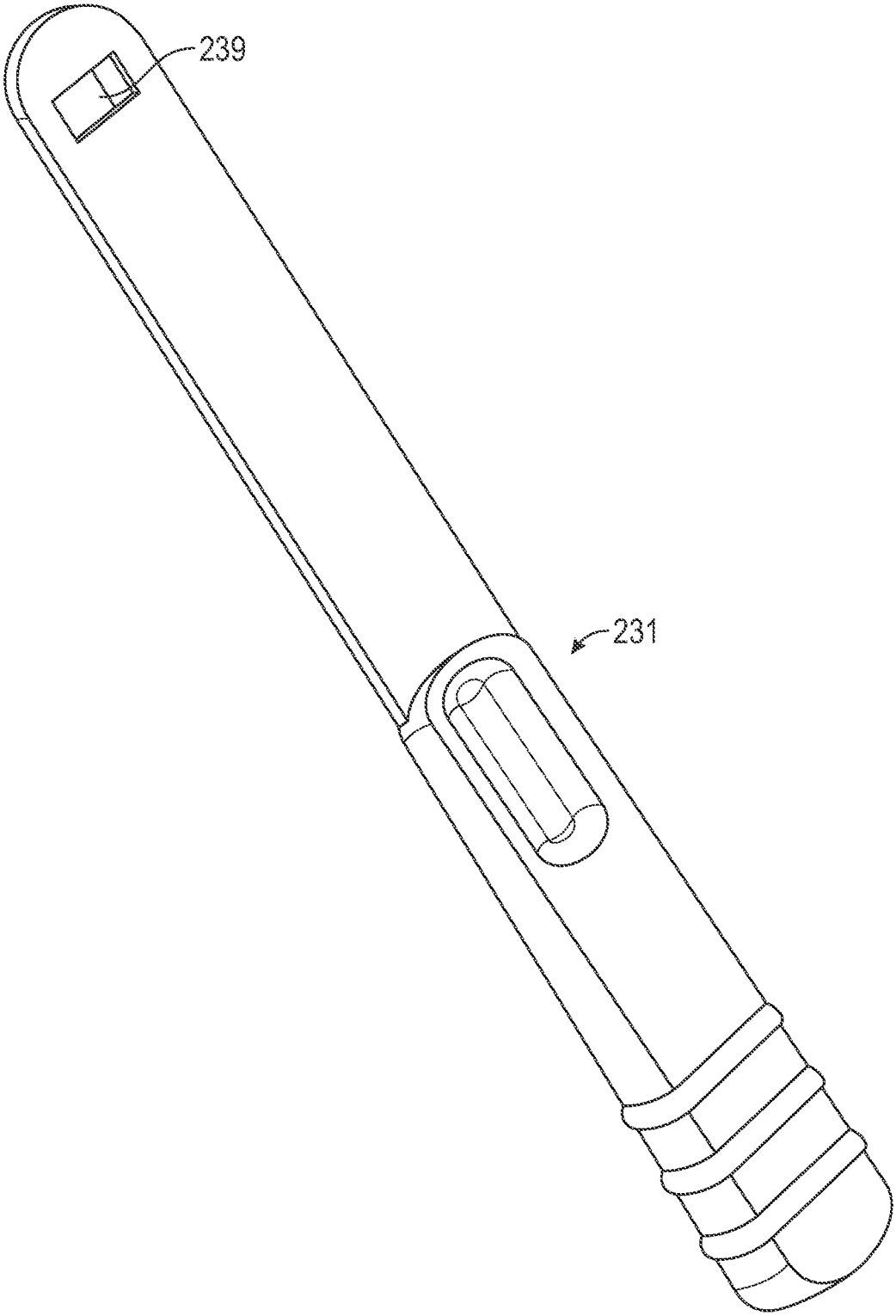
FIG. 7 is an isometric view of an alternate embodiment of a trowel for making sand castles.

Alternate embodiments can include a method to build the sand castle. For example, the method can include one or more of the following: placing the open bottom 109 of the body 101 on a surface, such as a sandy surface; partially filling the body 101 through the open top 111 with a material or substrate, such as sand; pouring water through the open top 111 on the sand inside the body 101 and filling the body 101 with water to adjacent the open top 111 of the body 101, thereby allowing the water to pack the sand inside the body 101 and draining the water from the open bottom 109 of the body 101; filling the body 101 to adjacent the open top 111 with wet sand and packing the wet sand from the open top 111 of the body 101; tapping an exterior of the sidewall 105 about the vertical axis 103 with a tool (e.g., trowel 131; FIG. 4) to slightly compress the wet sand inside the body 101; and/or vertically lifting the handle 117 of the body 101 to remove the body 101 from the sand castle. In another example, the method can include partially filling about 50% to about 80% of the body 101 with sand.

Embodiments also can include a kit for building sand castles. For example, the kit can include molds. Each mold can include a body (e.g., body 101, body 201) consisting of a single, monolithic, hollow structure. Each structure can have a vertical axis 103 and a sidewall 105 that is continuous and uninterrupted in a rotational direction about the vertical axis 103. Each sidewall 105 can have an inner pattern 107 that is castle-like in appearance. The inner pattern 107 can form an outer pattern in sand located inside the body 101. Each body also can have an open bottom 109, an open top 111 that is completely unobstructed and has no inward protrusion, and a top radial dimension 113 at the open top 111 is smaller than a bottom radial dimension 115 at the open bottom 109 such that the body 101 is tapered. Each mold can be a different shape.

In some versions, a first one of the molds 101 is generally cylindrical and tapered, and a second one of the molds 201 is generally rectangular and tapered. Each mold 101 can have a handle 117 that extends from the body adjacent the open top 111. The handle 117 can be used to vertically lift the body 101 from the sand located inside the body 101 to form a freestanding sand castle without support from the body 101.

Examples of the kit can include the bucket 141 (FIGS. 5 and 17) with a central axis 142, a generally frustoconical shape, an open top 143, a closed bottom 144, a flange 145 circumscribing the open top 143, a spout 146 adjacent the flange 145, a pair of handles 147, such as (FIG. 5) extending radially from opposite sides of the bucket 131 below the flange 145, and reinforcement ribs 148 circumscribing the bucket 141 below the handles 147.

Embodiments of the kit can further include a roof top mold 151 (FIG. 6) can include a central axis 152, an open bottom 154, a closed top 155, a generally conical, tapered shape, and the handle 153 extending from the closed top 155 in a single vertical plane. The closed top 155 can include apertures 156 (e.g., drain holes) configured to drain water and prevent sand from sticking to the roof top mold due to vacuum. The roof top mold 151 can have more or fewer holes than those shown in FIG. 6.

Figure 3:
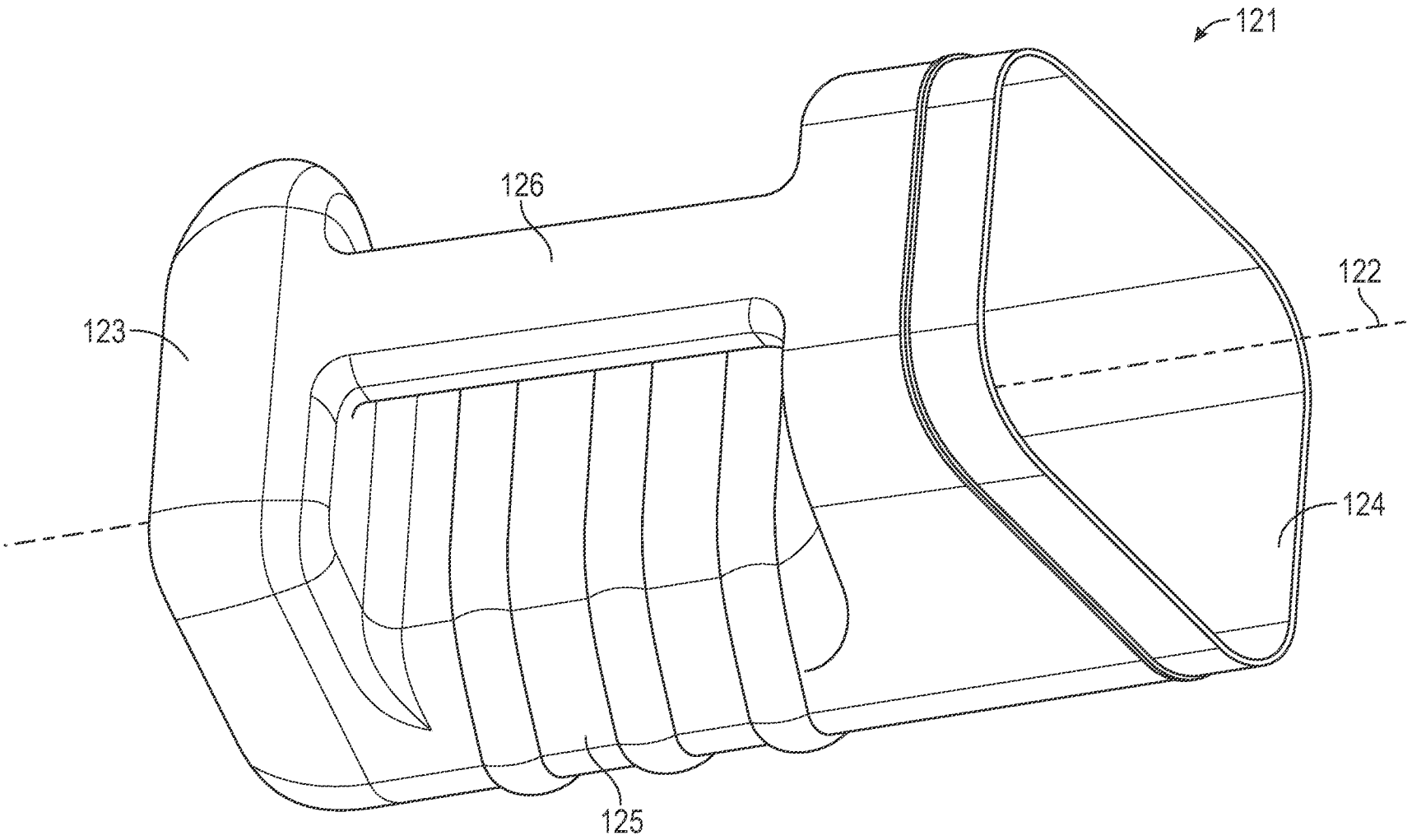
FIG. 3 is an isometric view of an embodiment of a scoop for making sand castles.

Other versions of the kit can include the scoop 121 (FIG. 3). The scoop 121 can have a generally rectangular shape with an axis 122, a closed proximal portion 123, an open distal portion 124, a hollow body 125 that connects the closed proximal portion 123 to the open distal portion 124, and a hollow handle 126 that connects the closed proximal portion 123 to the open distal portion 124. The closed proximal portion 123 and open distal portion 124 can have a similar radial size relative to the axis 122. The hollow body 125 can be smaller in radial size than the overall radial size of the scoop 121. The hollow handle 126 can be smaller in radial size than the hollow body 125.

Examples of the kit can include the trowel 131 (FIG. 4). The trowel 131 can have a handle 133 with a thumb receptacle 135, a rounded blade 137 extending from the handle 133, and the handle 133 and rounded blade 137 can be in separate planes, such that they are not co-planar.

Figure 8:
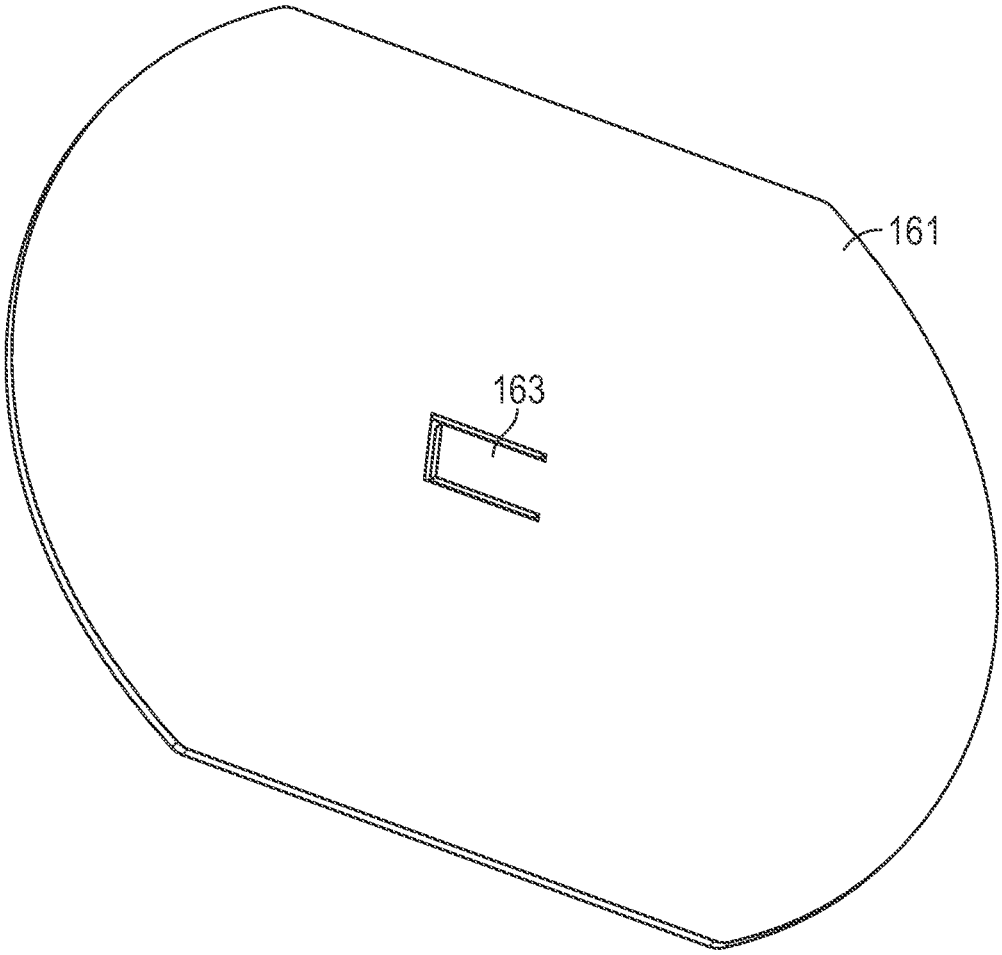
FIG. 8 is an isometric view of an embodiment of a platform for making sand castles.
Figure 9:
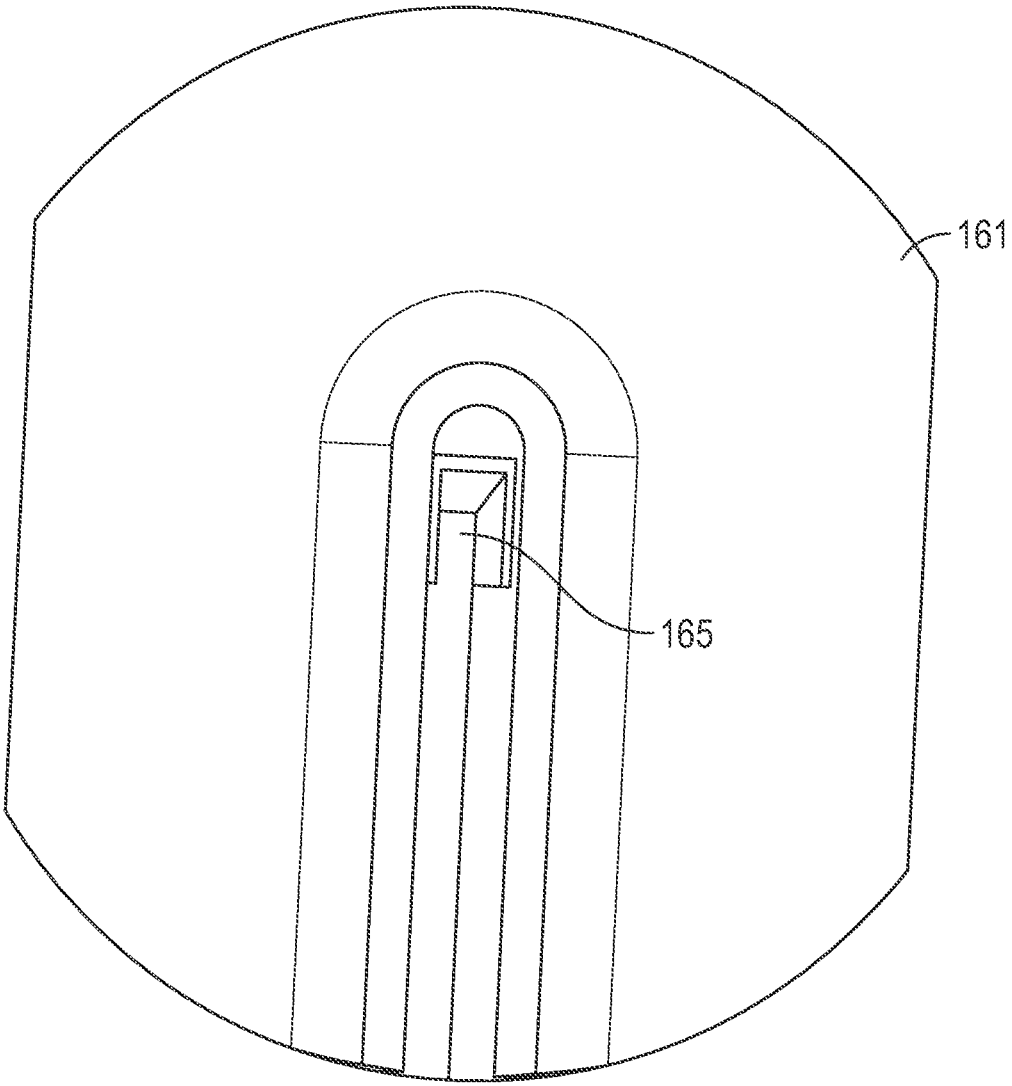
FIG. 9 is a reverse isometric view of the platform of FIG. 8.
Figure 10:
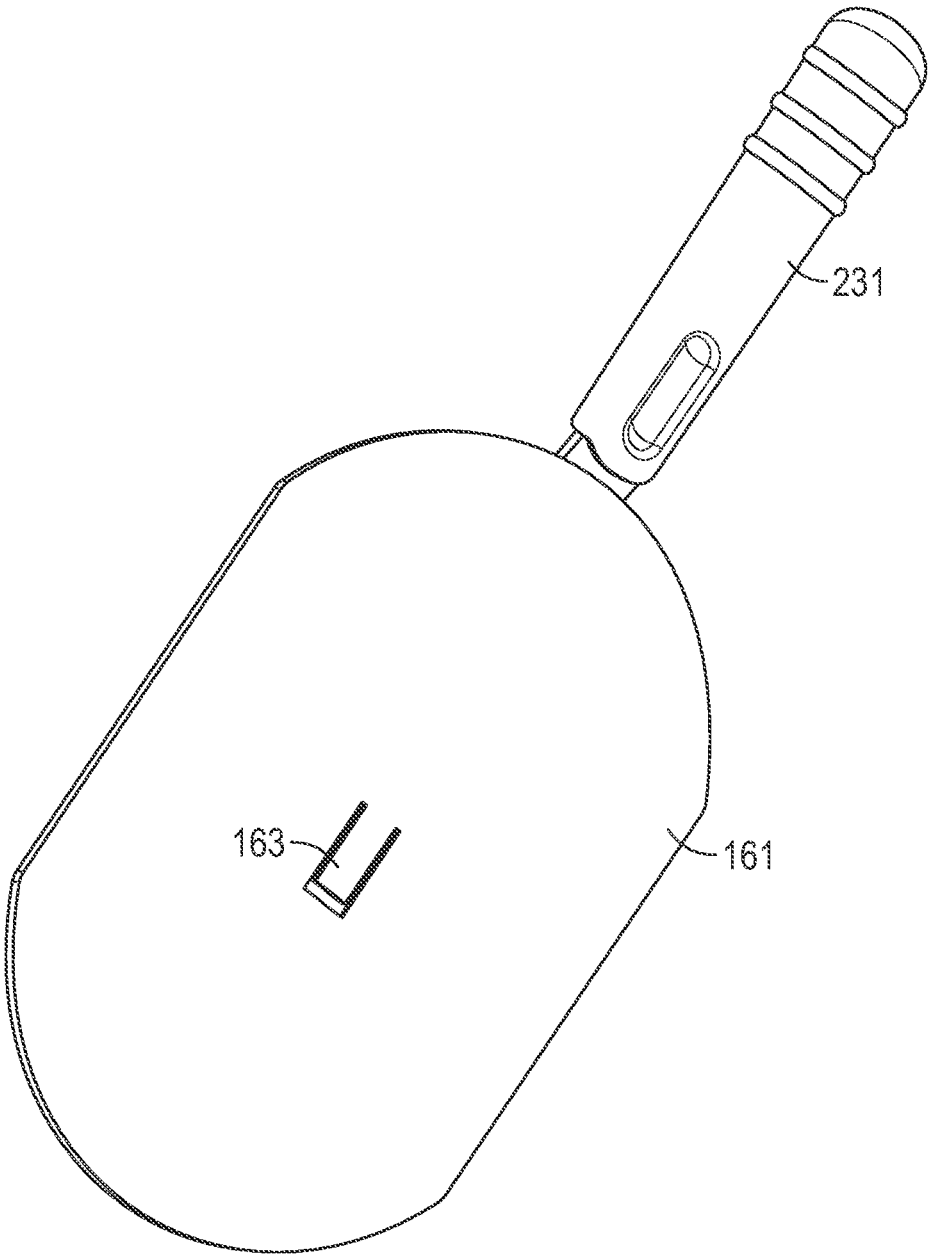
FIG. 10 is an isometric view of the trowel of FIG. 6 and the platform of FIG. 8 assembled together.
Figure 11:
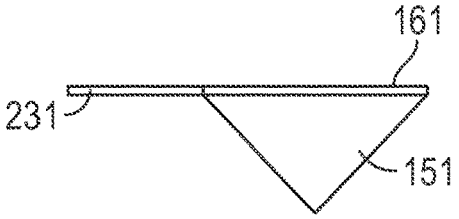
FIGS. 11-14 are schematic, sequential images of embodiments of the trowel, platform and molds for making sand castles.

Referring now to FIGS. 7-14, alternate embodiments are disclosed. For example, FIG. 7 discloses a trowel 231 that is very similar to trowel 131 (FIG. 4). However, trowel 231 can have a handle and blade that are co-planar. Also, trowel 231 can include a mechanical fastener 239, such as a bracket, clasp or tab. The fastener 239 is configured to be releasably attached to a platform 161 (FIGS. 8-10). The platform can include its own fastener, such as a tab 163 that is opposite a groove and receptacle 165 (FIG. 9). The fastener 239 on trowel 231 can slidably, releasably engage and couple to the tab 163, groove and receptacle 165 on platform 161, as shown in FIG. 10.

Figure 12:
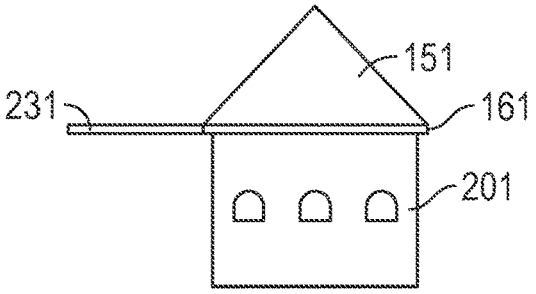

A sequence for using these tools and a method of making a sand castle are depicted in FIGS. 11-14. For example, in FIG. 11 the roof top mold 151 is filled with sand as described herein. The trowel 231 is assembled to the platform 161 so that the trowel 231 forms a handle for the platform 161. The platform 161 is placed on top of the sand and roof top mold 151, as shown. Next, with the platform positioned securely against the sand and roof top mold 151, the entire assembly is inverted, upside down, as shown in FIG. 12. The platform 161 (via trowel 231) is used to help keep the sand located inside roof top mold 151 in place. The "assembly" of the roof top mold 151, sand, platform 161 and trowel 231 is placed on top of mold 201, which is already filled with sand as described herein. At this stage, the platform 161 is sandwiched between the top of the sand and mold 201, and the sand and bottom of roof top mold 151.

Figure 13:
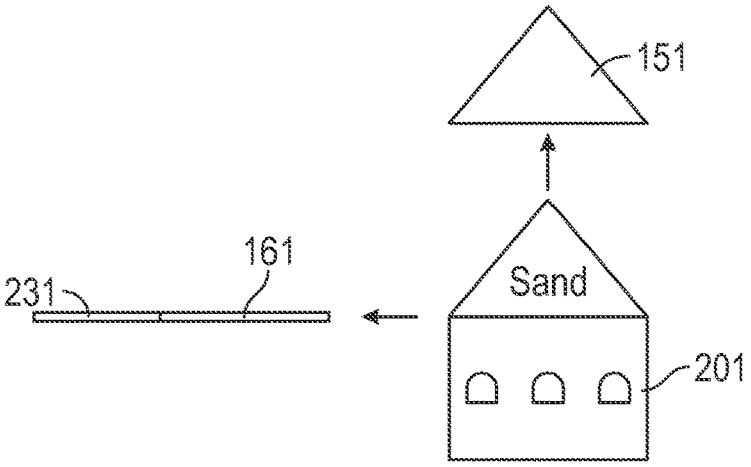
Figure 14:
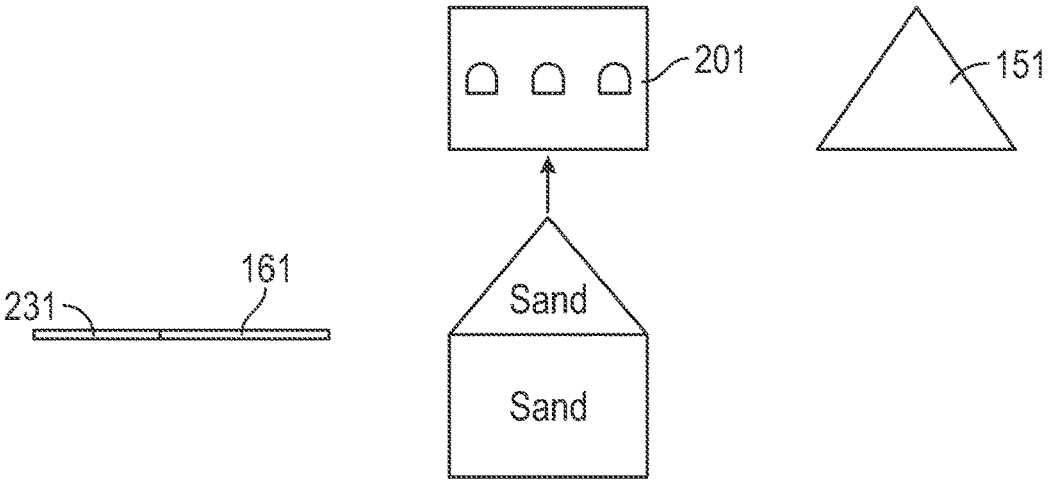

In FIG. 13, the platform 161 is horizontally removed with trowel 231 by pulling it out from between the sand located in roof top mold 151 and mold 201. The roof top mold 151 is then lifted to expose the sand that was inside the roof top mold 151. Finally (FIG. 14), the mold 201 is removed to expose the sand that was inside the mold 201.

Figure 15:
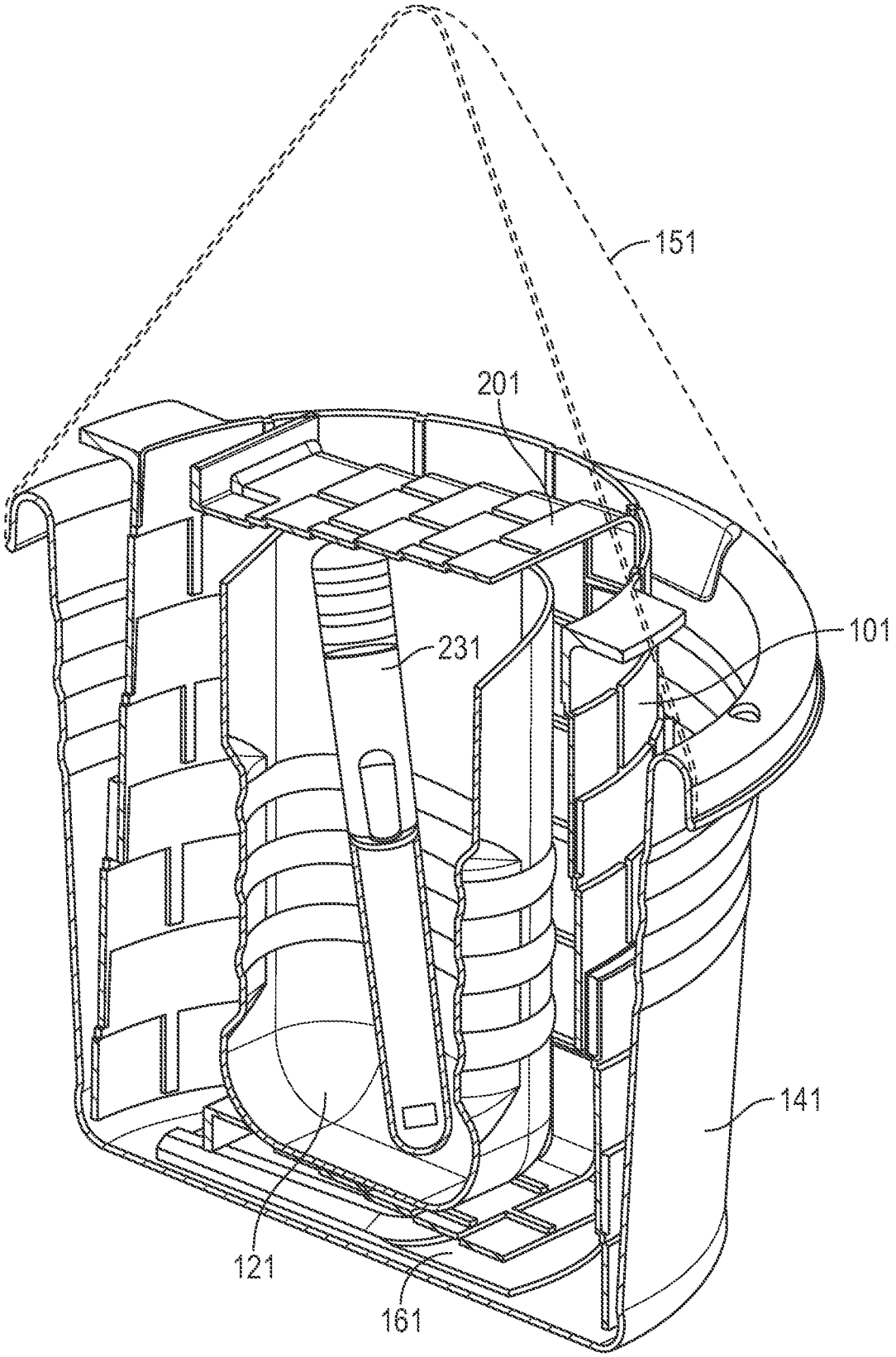
FIG. 15 is a half-sectional, isometric view of the components assembled together in a storage configuration when not in use.
Figure 16:
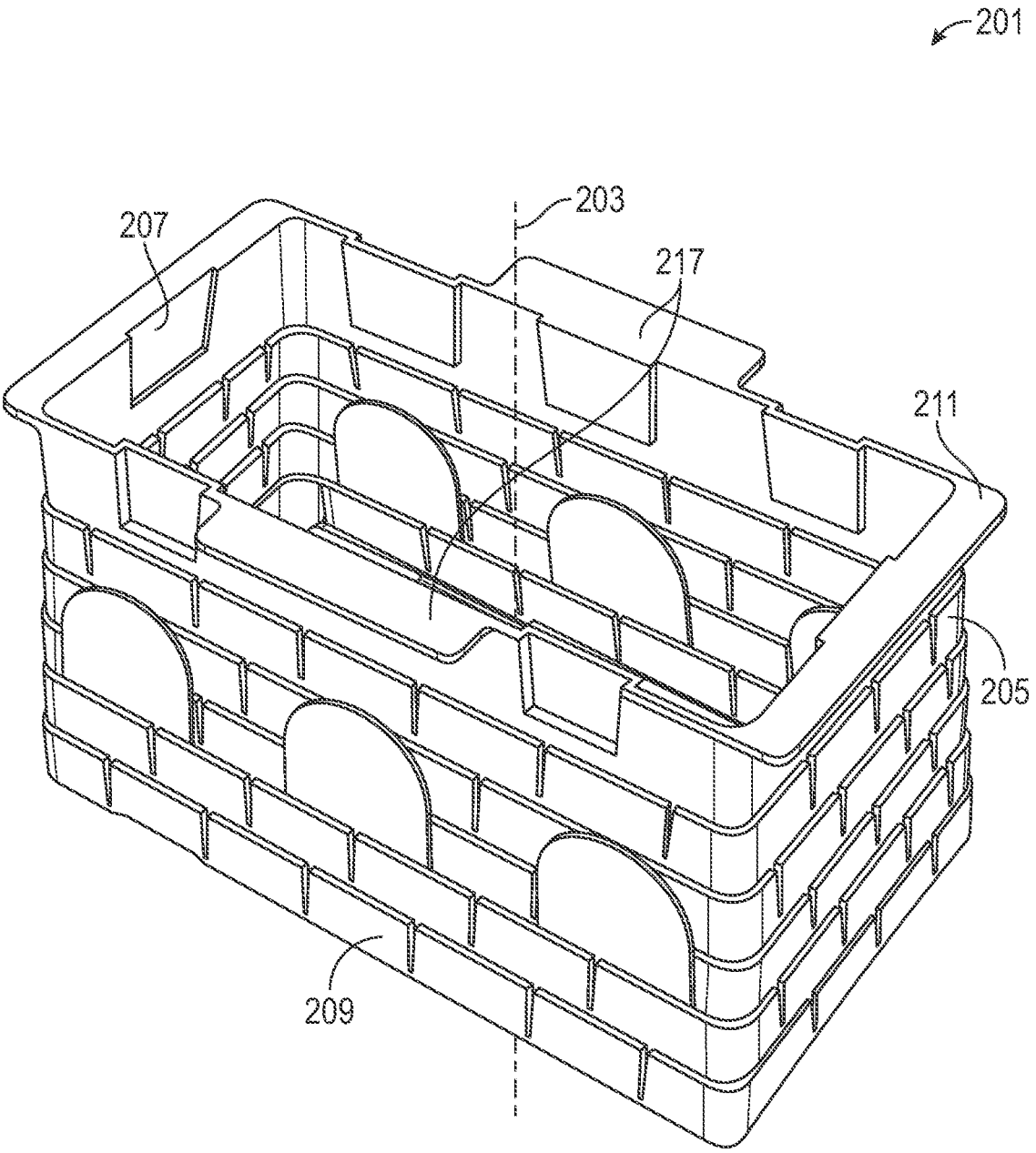
FIG. 16 is an isometric view of another alternate embodiment of a mold for making sand castles.
Figure 17:
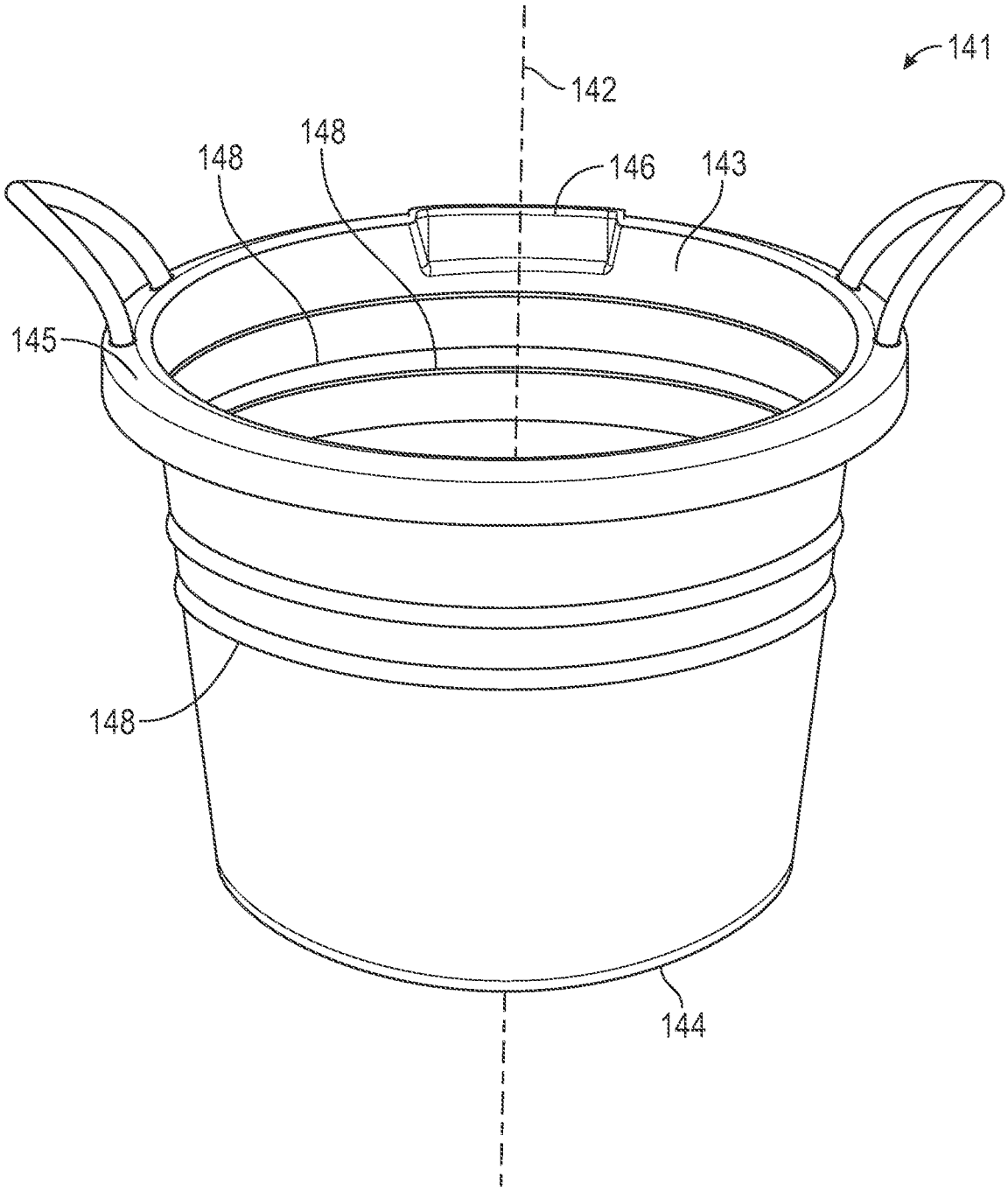
FIG. 17 is an isometric view of another embodiment of a bucket for making sand castles.

FIG. 15 depicts a storage configuration for the various components of the kit. For example, the platform 161 can be placed at the bottom of the bucket 141. The trowel 231 can be placed inside the scoop 121. The scoop 121 and trowel 231 can be placed inside the mold 201, which can, collectively be placed inside the mold 101. Collectively, the mold 101, mold 201, scoop 121 and trowel 231 can be placed on top of the platform 161 at the bottom of the bucket 141. The roof top mold 151 can then be placed on top of the bucket 141 to complete the assembly and store the components when not in use. The sizing and structure of each component and their compact collection distinguishes other conventional solutions. Thus, these embodiments beneficially allow the packing of both a functional scoop (e.g., shovel), bucket and the molds in the same kit in a very compact storage manner compared to any existing product.

In some versions of the kit, the molds, bucket, roof top mold, scoop and trowel are molded from a same material comprising a polymer. Each of the molds, bucket, roof top mold, scoop and trowel can comprise or consist of a single monolithic structure that is not an assembly.

These embodiments can offer advantages over conventional solutions. The open top can be filled with sand and does not need to be transported. The open bottom drains water and allows the user to simply lift the mold off of the formed sand castle. Thus, there is no risk of damaging the sand structure due to flipping, like the prior art. In addition, the mold can be quite large since it does not have be transported or flipped. Thus, the user can make larger sand structures.

The designs also provide much stronger sand structures since heavy, wet sand can be used and then readily drained of water. The water draining process through the sand structure forms stronger bonds between the grains of wet sand. These designs also allow for greater margin of error for using different types of sand (e.g., damp vs dry), since the user can readily add water to the sand in the mold to form firmer sand structures. In addition, there is little risk of oversaturation as the water will naturally drain through the open bottom. These embodiments also allow for easy tapping on all sides of the mold. This further compresses the sand to make very solid sand structures that simply are not possible with typical closed molds. The transparent or translucent material of the mold also makes it unique among sand toys. The user can see the sand inside the mold and can located any air bubbles that need to be eliminated with either more water or sand, or by tapping the mold near the air bubbles.

The science behind sand castle building includes the interaction between water, sand and surface tension. Surface tension is what gives wet sand its strength for great sand castle building. The water molecules coat the grains of sand and hold them together, forming water-drop bridges in the gaps between the grains. Too little water, and surface tension cannot hold the sand grains together. Too much water, and the water turns into a lubricant and collapses the sand. Packing sand strengthens and tightens the water-drop bridges that hold the grains together. The sides of the mold can be tapped until the sand on top looks compact and almost dry. Thus the open top and open bottom disclosed herein promotes good surface tension between the water and sand since the water can drain.

Other versions may include one or more of the following versions.

1. Equipment for building sand castles, the equipment comprising:
   - a body comprises a single, monolithic, hollow structure having a vertical axis and a sidewall that is continuous and uninterrupted in a rotational direction about the vertical axis, the sidewall comprises an inner pattern that is castle-like in appearance, the inner pattern is configured to form an outer pattern in sand located inside the body, the body also comprises an open bottom, an open top that is completely unobstructed and has no inward protrusion adjacent to the open top, and a top radial dimension at the open top is smaller than a bottom radial dimension at the open bottom such that the body is tapered; and
   - a handle extending from the body adjacent the open top and configured to vertically lift the body from the sand located inside the body to form a freestanding sand castle without support from the body.

2. The equipment wherein the body has a shape selected from cylindrical, frustoconical or rectangular.

3. The equipment further comprising a scoop configured to fill the body with sand through the open top of the body.

4. The equipment further comprising a shaping and carving tool.

5. The equipment wherein the handle comprises external handles that are perpendicular to the vertical axis, and upper surfaces of the handles are flush with the open top of the body.

6. The equipment wherein the handle comprises external handles that extend vertically from the body.

7. The equipment wherein the handle comprises an external rim adjacent a perimeter of the open top.

8. The equipment wherein the body does not comprise separate components that are assembled to form the body.

9. The equipment wherein the open top of the body does not comprise an inner lip or an inner flange.

10. The equipment wherein the body is translucent or transparent.

11. The equipment wherein the body has no features configured to interlock with another tool.

12. The equipment wherein the body is not threaded.

13. The equipment wherein a method to build the sand castle comprises:
   - (a) placing the open bottom of the body on a sandy surface;
   - (b) partially filling the body through the open top with sand;
   - (c) pouring water through the open top on the sand inside the body and filling the body with water to adjacent the open top of the body, thereby allowing the water to pack the sand inside the body and draining the water from the open bottom of the body;
   - (d) filling the body to adjacent the open top with more sand and packing the sand from the open top of the body;
   - (e) tapping an exterior of the sidewall about the vertical axis with a tool to slightly compress the sand inside the body; and then
   - (f) vertically lifting the handle of the body to remove the body from the sand castle.

14. The method wherein step (b) comprises partially filling at least about 50% to about 80% of the body with sand.

15. A kit for building sand castles, the kit comprising:

molds, each mold comprises a body consisting of a single, monolithic, hollow structure, each structure comprises a vertical axis and a sidewall that is continuous and uninterrupted in a rotational direction about the vertical axis, each sidewall comprises an inner pattern that is castle-like in appearance, the inner pattern is configured to form an outer pattern in sand located inside the body, each body also having an open bottom, an open top that is completely unobstructed and has no inward protrusion adjacent to the open top, and a top radial dimension at the open top is smaller than a bottom radial dimension at the open bottom such that the body is tapered; and each mold comprises a different shape.

16. The kit wherein a first one of the molds is generally cylindrical and tapered, and a second one of the molds is generally rectangular and tapered.

17. The kit wherein each mold comprises a handle that extends from the body adjacent the open top, the handle is configured to vertically lift the body from the sand located inside the body to form a freestanding sand castle without support from the body.

18. The kit further comprising a bucket having a central axis, a generally frustoconical shape, an open top, a closed bottom, a flange circumscribing the open top, a spout extending from the flange, a pair of handles extending radially from opposite sides of the bucket below the flange, and reinforcement ribs circumscribing the bucket below the handles.

19. The kit further comprising a roof top mold having a central axis, an open bottom, a closed top, a generally conical shape, and a handle extending from the closed top in a single vertical plane, and the closed top comprises apertures configured to prevent sand from sticking to the roof top mold due to vacuum.

20. The kit further comprising a scoop having a generally rectangular shape with an axis, a closed proximal portion, an open distal portion, a hollow body that connects the closed proximal portion to the open distal portion, a hollow handle that connects the closed proximal portion to the open distal portion, the closed proximal portion and open distal portion have a similar radial size relative to the axis, the body is smaller in radial size than the similar radial size, and the handle is smaller in radial size than the body.

21. The kit further comprising a trowel comprising a handle with a thumb receptacle, a rounded blade extending from the handle, and the handle and rounded blade are co-planar.

22. The kit wherein the molds and a bucket, a roof top mold, a scoop and a trowel are molded from a same material comprising a polymer, and each of the molds, bucket, roof top mold, scoop and trowel respectively comprises a single monolithic structure that is not an assembly.

23. The kit further comprising a trowel having a fastener, and a platform having a platform fastener, such that the platform can be mounted to the trowel by coupling the platform fastener to the fastener to form an assembly.

24. The kit wherein the assembly is configured to support an underside of sand located in a roof top mold when the roof top mold is placed on top of one of the molds having sand therein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A kit for building castle, the kit comprising:

molds, each mold comprises a body consisting of a single, monolithic, hollow structure, each structure comprises a vertical axis and a sidewall that is continuous and uninterrupted in a rotational direction about the vertical axis, each sidewall comprises an inner pattern that is castle-like in appearance, the inner pattern is configured to form an outer pattern in a substrate located inside the body, each body also having an open bottom, an open top that is completely unobstructed and has no inward protrusion adjacent to the open top, and a top radial dimension at the open top is smaller than a bottom radial dimension at the open bottom such that the body is tapered; and each mold comprises a different shape; and a trowel having a fastener, and a platform having a platform fastener, such that the platform can be mounted to the trowel by coupling the platform fastener to the fastener to form an assembly.

2. The kit of claim 1, wherein each mold comprises a handle that extends from the body adjacent the open top, the handle is configured to vertically lift the body from the substrate located inside the body to form a freestanding castle without support from the body.

3. The kit of claim 1, further comprising a bucket having a central axis, a generally frustoconical shape, an open top, a closed bottom, a flange circumscribing the open top, a spout adjacent the flange, handles and reinforcement ribs circumscribing the bucket below the handles.

4. The kit of claim 1, further comprising a scoop having a generally rectangular shape with an axis, a closed proximal portion, an open distal portion, a hollow body that connects the closed proximal portion to the open distal portion, a hollow handle that connects the closed proximal portion to the open distal portion, the closed proximal portion and open distal portion have a similar radial size relative to the axis, the body is smaller in radial size than the similar radial size, and the handle is smaller in radial size than the body.

5. The kit of claim 1, wherein the trowel comprises a handle with a thumb receptacle, a rounded blade extending from the handle, and the handle and rounded blade are co-planar.

6. The kit of claim 1, wherein the molds and a bucket, a roof top mold, a scoop and the trowel are molded from a same material comprising a polymer, and each of the molds, bucket, roof top mold, scoop and trowel respectively comprises a single monolithic structure that is not an assembly.

7. The kit of claim 1, wherein the assembly is configured to support an underside of substrate located in a roof top mold when the roof top mold is placed on top of one of the molds having substrate therein.

* * * * *